US005085352A

United States Patent [19]

Sasaki et al.

[11] Patent Number: 5,085,352

[45] Date of Patent: Feb. 4, 1992

[54] DISPENSER FOR DISCHARGING MATERIAL AND HAVING RELATIVELY ROTATABLE MALE AND FEMALE SCREWS

[75] Inventors: Toshiyuki Sasaki; Takeshi Nagaki, both of Tokyo, Japan

[73] Assignee: Pentel Kabushiki Kaisha, Tokyo, Japan

[21] Appl. No.: 415,220

[22] PCT Filed: Jan. 26, 1989

[86] PCT No.: PCT/JP89/00070

§ 371 Date: Aug. 29, 1989

§ 102(e) Date: Aug. 29, 1989

[87] PCT Pub. No.: WO89/07078

PCT Pub. Date: Aug. 10, 1989

[30] Foreign Application Priority Data

Jan. 30, 1988 [JP] Japan ..... 63-11619
Jul. 11, 1988 [JP] Japan ..... 63-91591

[51] Int. Cl.[5] ..... B65D 8/854

[52] U.S. Cl. ..... 222/327; 222/390; 401/174

[58] Field of Search ..... 222/325, 326, 327, 386, 222/390, 192; 401/19, 24, 55, 64, 68-69, 172, 174

[56] References Cited

U.S. PATENT DOCUMENTS 1,362,937 12/1920 Grace ..... 401/174
2,309,861 2/1943 Mureau ..... 401/174
3,002,517 10/1961 Pitton ..... 222/390 X
3,756,730 9/1973 Spatz ..... 401/174
4,595,124 6/1986 Duval et al. ..... 222/39

FOREIGN PATENT DOCUMENTS 58-130614 9/1983 Japan .
59-10804 3/1984 Japan .

*Primary Examiner*—Michael S. Huppert
*Assistant Examiner*—Kenneth Bomberg
*Attorney, Agent, or Firm*—Wenderoth, Lind & Ponack

[57] ABSTRACT

A dispenser has, an elongated container having a storage portion for storing material to be dispensed, a female screw member fitted in the interior of the elongated container and held against longitudinal movement therealong, a male screw member having one end engaged with material in the storage portion and rotatably engagable with the female screw member for, when the male screw member is moved within the elongated container, pressing the material and discharging it from the dispenser. An element is connected to the screw members for rotating them relative to each other for axially moving the male screw member relative to the female screw member, and the female screw member has a plurality of parts, at least one of which is threaded, movable inwardly and outwardly of the male screw member for changing the diameter of the female screw member for engaging the female screw member with and releasing it from the male screw member. Another element is engaged by the female screw member for moving the parts inwardly into engagement with the male screw member and holding the part engaged.

6 Claims, 10 Drawing Sheets

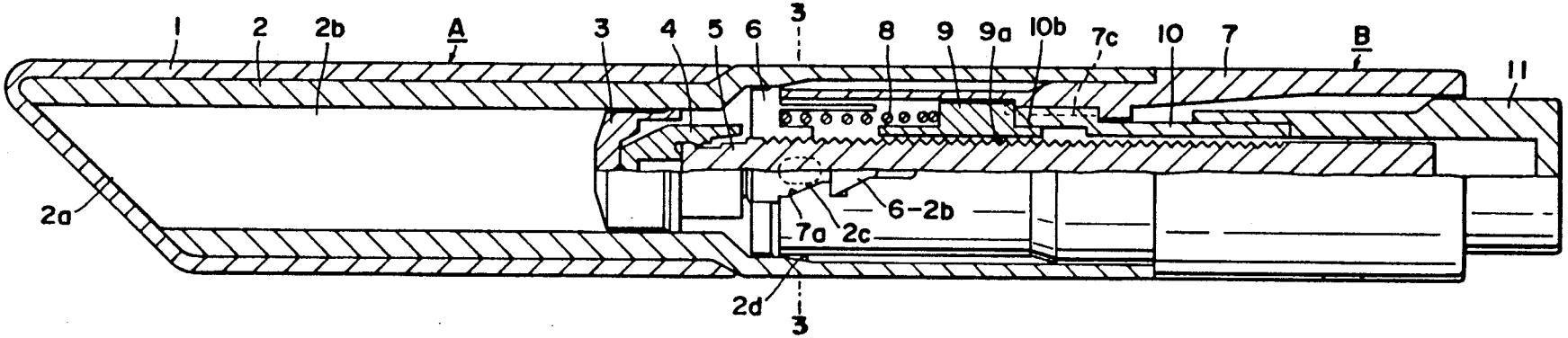
FIG. 1
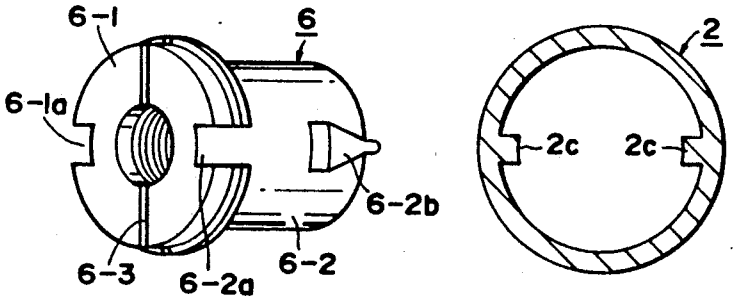
FIG. 2
FIG. 3
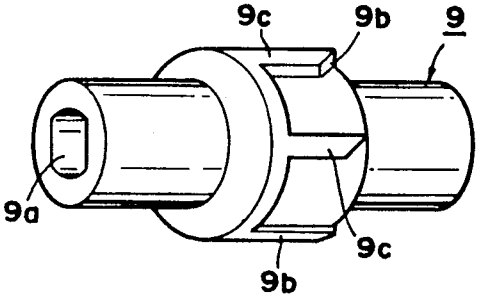
FIG. 4
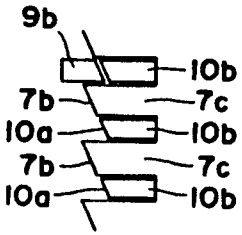
FIG. 5

DISPENSER FOR DISCHARGING MATERIAL AND HAVING RELATIVELY ROTATABLE MALE AND FEMALE SCREWS

TECHNICAL FIELD OF THE INVENTION

This invention relates in general to a dispenser or an extruding device of the type which engages and rotates a male screw member relative to a female screw member so that the male screw member can be advanced and a content, solid or fluid, stored in a container can be extruded or discharged for use. Examples of the content include cosmetics such as a makeup foundation, an eyeshadow, a lip color, etc., writing materials such as a crayon, a pastel crayon, ink, India ink, etc., machine oil, a paste, seasonings, and so forth.

BACKGROUND OF THE INVENTION

A typical example of the dispensers for dispensing the materials described above is a syringe. Such dispensers are known in various other fields such as cosmetics, writing instruments, and the like.

Various dispensing methods of the contents are also known. As one of the methods of classification, they can be divided into the group which advances a male screw member on the basis of force or rotation and the group which does not use a screw. In accordance with the former, the male screw member is meshed with a female screw member formed in a predetermined length and is rotated so as to advance the male screw member. The present invention relates to the former, while an ordinary syringe is an example of the latter.

In comparison with the latter, the former which advances the male screw member on the basis of force of rotation is more advantageous in that the quantity of the content which is dispensed can be controlled and stabilized more easily. However, the structure often gets complicated, and this results in difficulty of assembly. Assembly of a really satisfactory dispenser is not so easy. If the assembly cannot regulate the advance of the male screw member, for example, unnecessary discharge of the content will develop when the dispenser is out of use. Extrusion of the content by the male screw member cannot be effected smoothly unless its movement in the axial direction is controlled. Therefore, the assembly must take this factor into consideration, too.

SUMMARY OF THE INVENTION

It is an object of the present invention to provide a dispenser which has a mechanical portion for dispensing the content as a unitary assembly independently of a container, which permits an easy assembly with a container having an arbitrary shape as the mating part, even by an amateur.

It is another object of the present invention to provide a male screw member advancing for dispensing the content which is able to release its engagement with a female screw member. More specifically, the female screw member consists of a plurality of female screw plates so that the diameter of the female screw member as a female screw can be changed variously. According to this structure, it becomes easy to carry out the assembly which can very easily change the advancing position of the male screw member.

It is still another object of the present invention to provide a structure which permits the end portion of a content storage portion of the container to determine the dispensing direction of the content by the male screw member More specifically, this can be accomplished by providing the female screw member with radial play or looseness relative to a casing for facilitating assembly.

In the case of a container which is a cartridge removably fitted into a main body, it is still another object of the present invention to provide a fitting member which makes it possible to directly fit the female screw member to the rear end portion of the cartridge. By this structure, assembly can be made easily so that the female screw member advances smoothly.

In the case of a container which is a cartridge removably fitted into the main body, it is still another object of the present invention to provide a fitting member wherein a main body includes mutually separable front and rear tubular shafts, the cartridge is fitted to the front tubular shaft from its back, a male screw member and a female screw member meshing with the male screw member are disposed on the rear shaft, and the tip of the male screw member can project from the tip of the rear tubular shaft even at the initial state of meshing of the male screw member with the female screw member. According to this structure, assembly can be carried out easily by judging and adjusting the advancing position of the male screw member.

In a first embodiment of the present invention, there is provided a dispenser comprising a male screw member meshing and rotating relatively with a female screw member in such a manner as to discharge a content stored in a storage portion of a container and a press portion for discharging the content by the male screw member as mechanical components, wherein the mechanical components are prepared as a unitary assembly and are assembled with the container.

In a second embodiment of the invention, the dispenser has a male screw member meshing and rotating relatively with a female screw member in such a manner as to discharge a content stored in a storage portion of a container and a press portion for discharging the content by the male screw member as mechanical components, wherein the female screw member has a plurality of female screw plates for changing the diameter of the female screw member as a female screw so that meshing of the female screw member with the male screw member can be released.

In a third embodiment of the invention, the dispenser has a male screw member meshing and rotating relatively with a female screw member in such a manner as to discharge a content stored in a storage portion of a container and a press portion for extruding the content by the male screw portion as mechanical components, wherein there is provided a radial play or looseness for facilitating assembly to the female screw member so that the direction of extrusion or discharging of the content by the male screw member is determined by the end portion of the storage portion of the container.

In a fourth embodiment of the invention, the dispenser has a main body and a cartridge fitted removably into the main body, wherein a male screw member and a female screw member meshing with each other and rotating relatively are disposed in the main body in such a manner as to be positioned at the back of the cartridge when the cartridge is fitted. When the male screw member is moved forward, a content stored in the cartridge is discharged and the female screw member is fitted removably and directly to the rear end portion of the cartridge.

In a fifth embodiment of the invention, the dispenser has a main body and a cartridge fitted removably into the main body, a male screw member and a female screw member meshing with each other and rotating relatively in the main body in such a manner as to be positioned at the back of the cartridge when the cartridge is fitted, and wherein when the male screw member is moved forward, a content stored in the cartridge is discharged. The main body includes a front tubular shaft and a rear tubular shaft that can be separated from each other, and the cartridge is fitted to the front tubular shaft from its back. The male screw member and the female screw member are disposed on the side of the rear tubular shaft and the tip of the male screw member projects from the tip of the rear tubular shaft even at the initial state of meshing between the male screw member and the female screw member.

BRIEF DESCRIPTION OF THE DRAWINGS

FIG. 1 is a longitudinal sectional view showing a first embodiment of the present invention;

FIG. 2 is a perspective view showing an example of the shape of a female screw;

FIG. 3 is a transverse sectional view of a container main body 2, taken along line 3—3 of FIG. 1;

FIG. 4 is a perspective view showing an example of the shape of a rotor;

FIG. 5 is a diagram for explaining the operation of a rotary mechanism;

FIGS. 22 through 41 show components used for the eighth embodiment and several modified examples thereof; wherein FIG. 22 is a longitudinal sectional view of a front tubular shaft;

FIG. 23 is a longitudinal partial sectional view of a container;

FIG. 24 is a longitudinal partial sectional view of a piston;

FIG. 25 is a longitudinal partial sectional view of a rear tubular shaft;

FIG. 26 is a transverse sectional view taken along line 26—26 of FIG. 25;

FIG. 27 is a transverse sectional view taken along line 27—27 of FIG. 25;

FIG. 28 is a side view of a male screw member;

FIG. 29 is an end view of the male screw member of FIG. 28;

FIG. 30 is a transverse sectional view taken along line 30—30 of FIG. 28;

FIG. 31 is an end view of the female screw member in the assembly state;

FIG. 32 is a longitudinal partial sectional view of the female screw member in FIG. 31;

FIG. 33 is an end view of the female screw member in the molding state;

FIG. 34 is a longitudinal partial sectional view of the female screw member in FIG. 33;

FIG. 35 is a side view of the rotor;

FIG. 36 is a transverse sectional view taken along line 36—36 of FIG. 35;

FIG. 37 is a transverse sectional view taken along line 37—37 of FIG. 35;

FIG. 38 is a front view of a slider;

FIG. 39 is a longitudinal partial sectional view of the slider in FIG. 38;

FIG. 40 is a longitudinal partial sectional view of a pushing member;

FIG. 41 is a transverse sectional view taken along line 41—41 of FIG. 40; and

PREFERRED EMBODIMENT OF THE INVENTION

Figure 6:
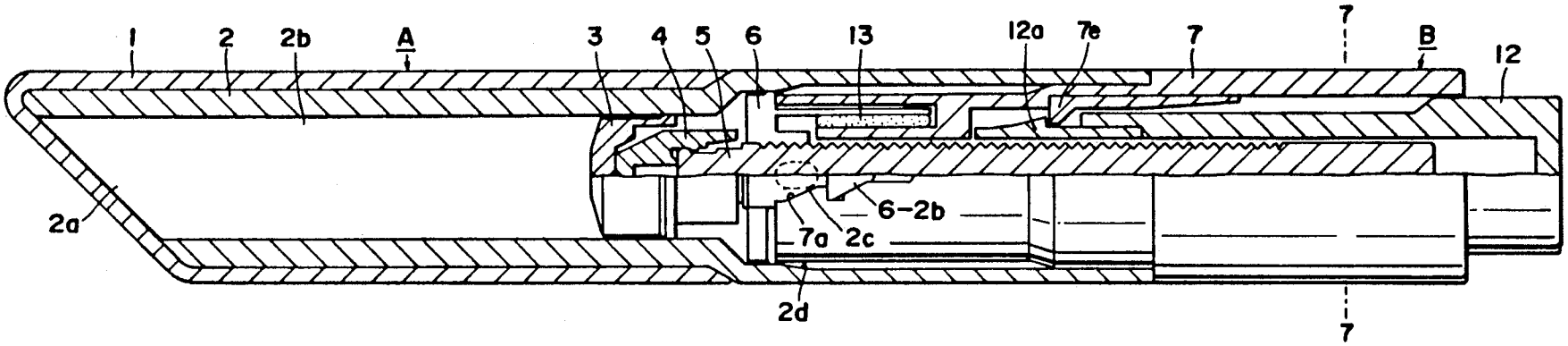
FIG. 6 is a longitudinal sectional view showing a second embodiment.

Although each of the features of the present invention described above can be used individually, they are more preferably combined with one another. Therefore, the following description will represent some embodiments which incorporate some of these features simultaneously.

FIGS. 1 to 4 of the accompanying drawings illustrate the first embodiment. Reference symbol A designates a container number and B a tubular shaft body. The container member A of this embodiment has a cap 1, a container 2 whose inclined opening 2*a* is sealed by the cap 1 and a piston 3 which is disposed in such a manner as to capable of sliding inside the container 2. A desired content is stored in a space 2*b*. On the other hand, the tubular shaft body B has a male screw member 5 for advancing the piston 3, which member is equipped with a ring-like member or a crown 4 fitted thereto, a female screw member 6, a tubular shaft 7, a resilient member 8, a rotor 9 biased rearward by the resilient member 8, a slider 10 for advancing the rotor 9 against the force of the resilient member 8 and prevented from moving back by the tubular shaft 7, and a pusher 11 as a press portion which is fixed to the rear end of the slider 10 and projects rearward These members 5 through 11 are assembled integrally with one another.

As shown in FIG. 2, the female screw member 6 consists of two female screw plates or screw halves 6-1 and 6-2 divided longitudinally. Each female screw plate 6-1, 6-2 is equipped with a notch 6-1*a*, 6-2*a* for passing to a corresponding projection 2c formed on the inner wall of the container 2, and with a projection 6-1b, 6-2b (with the projection 6-1b not being visible in the drawing) at the rear part of the corresponding screw plate 6-1, 6-2 and 7a formed in the tubular shaft 7 to prevent it from falling off to integrate the female screw member 6 with the tubular shaft 7. In other words, the projections 2c of the container 2 prevent the backward movement of the female screw member 6 insures its position and also prevents the tubular shaft 7 from falling off.

When the tubular shaft body B if off the container A, this female screw member 6 can have a gap 6-3 between the female screw plates 6-1 and 6-2 (shown in FIG. 2) but when the tubular shaft body B and the container A are assembled, it comes into contact with the inner hole of the container 2, reduces its diameter in such a manner as to reduce or eliminate the gap 6-3 with the inner hole being a guide, and meshes with the male screw member 5. This diameter reduction displacement of the female screw member 6 insures that the advancing direction of the male screw member 5 is axial of the container. In FIG. 1, a taper 2d is shown formed in the inner wall of the container 2 so that when the female screw member 6 passes through this taper 2d, the diameter of the female screw member 6 is reduced gradually. Incidentally, FIG. 1 shows the state immediately after the notches 6-1a and 6-2a get beyond the projections 2c and when the dispenser of the invention is used in practice, prevention of backward movement and positioning of the female screw member 6 by the projections 2c are effected by rotating the tubular shaft body B, by 45° for example.

Next, the advance mechanism of the male screw member 5 will be explained. This embodiment represents an example where a rotary mechanism for converting reciprocal axial movement to rotary movement is employed, and pushing of the pusher 11 results in rotation involving the forward and backward movement of the rotor and this rotation is transmitted to the male screw member 5.

FIG. 4 shows the rotor 9, which has an axial hole 9a having an irregular shape or an irregular-shaped cross section. The male screw member 5 is fitted into this inner hole 9a. The male screw member 5, too, has an irregular-shaped complementary cross section so that when the rotor 9 is rotated, the male screw member 5 is also rotated. The rotor 9 has projections 9c whose rear ends 9b have a unidirectional slope. The slider 10 has a plurality of projections 10b whose rear ends 10a have a unidirectional slope and the tubular shaft 7 is equipped on its inner wall with projection 7c whose rear ends 7b have a unidirectional slope.

As shown in FIG. 5, each projection 10b of the slider 10 first fits slidably into a recess between the adjacent projections 7c on the inner surface of the tubular shaft 7. Here, the foremost part of the front end 10a of the projection 10b is somewhat to the rear of the front end 7b of the projection 7c at the rearmost retreat position of the slider 10 and similarly, the front end of the projection is somewhat to the front of the foremost part of the front end 7b of the projection 7c at the foremost advance position of the slider 10. The dimension and amount of sliding of these members are set in such a manner as to satisfy the conditions described above. The rotor 9 which is biased backward by the resilient member 8 is positioned in front of the slider 10. The projections 9c of this rotor 9 can fit slidably into the recesses between the projections on the inner wall of the tubular shaft 7 in the same way as the projections 10b of the slider 10.

Accordingly, when the pusher 11 is not pushed, each projection 9c of the rotor 9 is in the state where it is somewhat fitted into the recess between the projections 7c of the inner wall of the tubular shaft 7 together with the opposed projection 10b of the slider 10 and the rear end 9b of the projection 9c is in contact with the front end 10a of the projection 10b of the slider 10 and moreover, since the rear end 9b of the projection 9c and the front end 10a of the projection 10b are sloped surfaces, the rotor 9 attempts to slide but is restricted by the sidewalls of the projections 7c of the inner wall of the tubular shaft 7. When the pusher 11 is pushed forwardly from this state, the rear end 9b of the projection 9c of the rotor 9 slips from the front end 10a of the projection 10b of the slider 10 when restriction by the sidewalls of the projections 7c on the inner wall of the tubular shaft 7 is released. In other words, the rotor 9 rotates to some extent. When the pushing of the slider 10 is stopped and the slider 10 is moved back, the rotor 9 further rotates because the rear end 9b of the projection 9c slips this time from a front end 7b of the projection 7c of the inner wall of the tubular shaft 7. In this manner, when the slider 10 moves through one reciprocation, the rotor 9 rotates by one pitch of the projections 7c, rotates male screw member 5 which is moved forward through female screw member 6, and a predetermined quantity of content is thus discharged.

Figure 7:
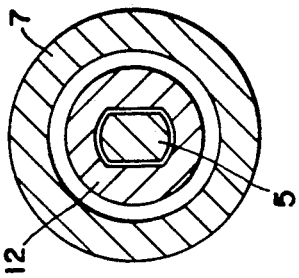
FIG. 7 is a transverse section view taken along line 7—7 in FIG. 6.

FIGS. 6 and 7 show the second embodiment, wherein like reference numerals are used to represent like parts and elements.

This embodiment represents an example where the male screw member 5 is moved forward by a mechanism other than the rotary mechanism, and the knob 12 is rotated to advance the male screw member 5 and functions as a device that corresponds functionally to the slider 10 and the pusher 11 of the previous embodiment of FIGS. 1 through 5. In other words, when the knob 12 is rotated, only the male screw member 5 is moved forward because the longitudinal movement of the knob 12 with respect to the tubular shaft 7 is restricted by tubular element 7e on the inside of tubular shaft 7 and front part 12a of knob number 12, as shown in FIG. 7.

This embodiment is somewhat less advantageous than the first embodiment in terms of being incapable of single-handed operation and discharging of a predetermined quantity of content but, on the other hand, is more advantageous in that the mechanism described above can move the male screw member 5 rearward simply by reversely rotating the knob 12. In other words, in order to clarify the comparison with the first embodiment, this embodiment, too, includes the piston 3 but depending on the nature of the content, there may be a case wherein a retracting force is preferably generated in addition to discharge. In such a case, it is possible to move the content in the interlocking arrangement with the male screw member 5 without using the piston 3. Incidentally, the piston 3 need not push the content in liquid tight engagement with container 2.

In the embodiment of FIGS. 6 and 7, a resilient member 13 is interposed between the female screw member 6 and the tubular shaft 7 and in the drawing is shown in a compressed state. When the tubular shaft body B is removed from the container A, the resilient member expands to provide positive expansion of the diameter of the female screw 6.

Figure 8:
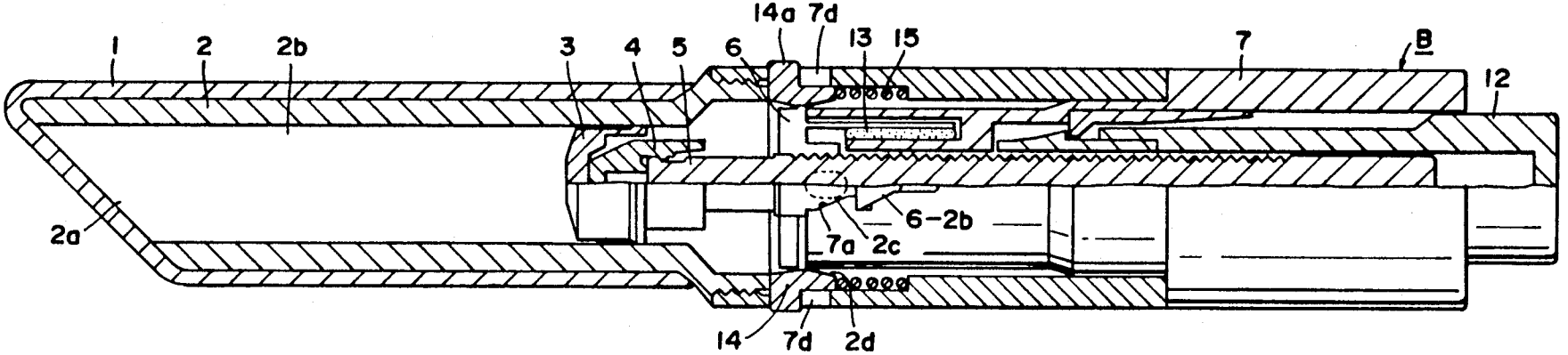
FIG. 8 is a longitudinal sectional view showing a third embodiment.
Figure 10:
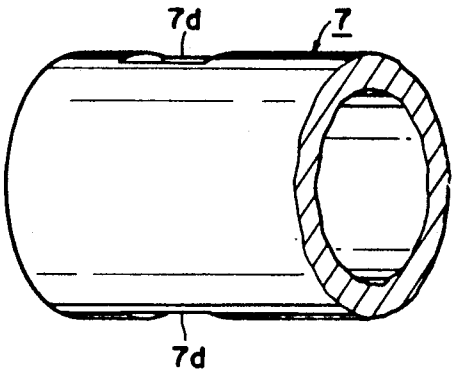
FIG. 10 is a perspective view of the principal portions of a casing or a tubular shaft.
Figure 9:
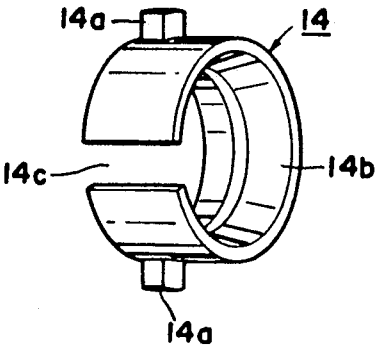
FIG. 9 is a perspective view of a diameter changing member.

FIGS. 8 to 10 show the third embodiment. The essential difference of this embodiment from the foregoing embodiments lies in that a diameter changing member 14 of substantially C-shaped configuration is provided for the tubular shaft 7 so that the diameter of the female screw of the female screw member 6 can be changed only on the tubular shaft body B side. This diameter changing member 14 includes a projection 14*a* that projects from longitudinal extending hole 7*d* in the tubular shaft 7 and a central bore 14*b* the diameter of which is reduced at its mid-length portion. The diameter changing member 14 is biased forward by a resilient member such as a spring 15 disposed at the rear thereof. When the projection 14*a* is pressed rearward against the force of the spring 15, the female screw member can expand radially so that the screw engagement between the male screw member 5 and the female screw member 6 can be released even when the container A and the tubular shaft body B are in the assembled state or when the tubular shaft body B is removed from the container A. In FIG. 9, reference numeral 14*c* represents a gap or a notch formed for reducing the diameter of member 14 so that the projection 14*a* can be easily fitted into the hole 7*d* of the tubular shaft 7.

Figure 11:
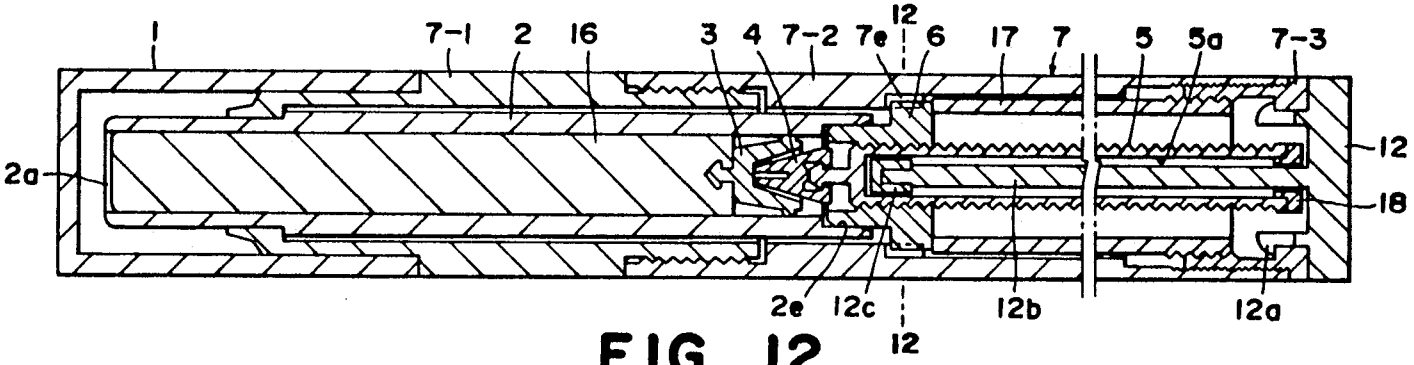
FIG. 11 is a longitudinal sectional view showing a fourth embodiment.
Figure 12:
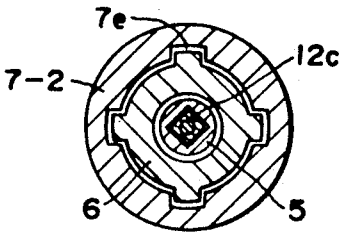
FIG. 12 is a transverse sectional view taken along line 12—12 of FIG. 11.

FIGS. 11 and 12 show the fourth embodiment. Reference numeral 7-1 designates a front tubular shaft, and a container 2 as a removably fitted cartridge is inserted into this front tubular shaft 7-1 from its rear in such a manner that the tip of an opening 2*a* of an inner bore projects from the front tubular shaft. This embodiment is useful for contents 16 which do not have fluidity but have a stick-like structure such as a lip color, paste, crayon, pastel, and the like.

A rear tubular shaft 7-2 is separable from the front tubular shaft 7-1, and a ring 7-3 is fixed to the rear end of this rear tubular shaft 7-2. A pawl 12*a* is engaged with the ring member 7-3 so that a knob 12 on which pawl 12*a* is mounted and which serves also as an end cap can be rotated. The knob 12 includes a rod-like portion 12*b* that projects forward, and a tip member 12*c* is fixed to its tip.

The male screw member 5 is disposed around the rod-like member 12*b* and tip member 12*c* and the female screw member 6 meshes with the male screw member 5.

As shown in FIG. 12, the tip member 12*c* and the inner bore 5*a* of the male screw member 5 are irregular in cross section and have odd-shaped complementary cross sections, and the rotation of the female screw member 6 is prevented by projections (unnumbered) engaged in grooves 7*e* formed on the inner wall of the rear tubular shaft 7-2. Accordingly, when the knob 12 is rotated with respect to the rear tubular shaft 7-2, the male screw member 5 moves forward.

Then, the male screw member 5 pushes the piston 3 which serves also as a rear plug of the container 2, through the crown 4 so that the content 16 is extruded. The crown 4 serves to minimize a torsional force on the piston 3 due to the rotating advance of the male screw member 5. Reference numeral 17 designates a stopper to restrict the retracting movement of the female screw member 6, and which projects from the ring 7-3, and reference numeral 18 designates a ring serving to prevent the male screw member 5 from falling or dropping out of the instrument.

The rotation of the female screw member 6 with respect to the rear tubular shaft 7-2 is prevented by the female screw member 6 is not fixed to the rear tubular shaft 7-2. Instead, its front portion is fitted to the rear end portion 2*e* of the container 2 by an increased diameter portion. This fitting determines the position of the female screw member 6 to the container 2 as well as the direction of the meshing of the male screw member 5 with the female screw member 6. If this fitting requires a pushing force to make a force fit, the retreat prevention member 17 becomes unnecessary. In such a case, the female screw member 6 can move backward at the time of replacement of the container 2, but it is possible to employ the arrangement wherein the length of the grooves 7*e* of the rear tubular shaft 7-2 are extended so that the female screw member 6 does not come out of these grooves 7*e*.

Figure 13:
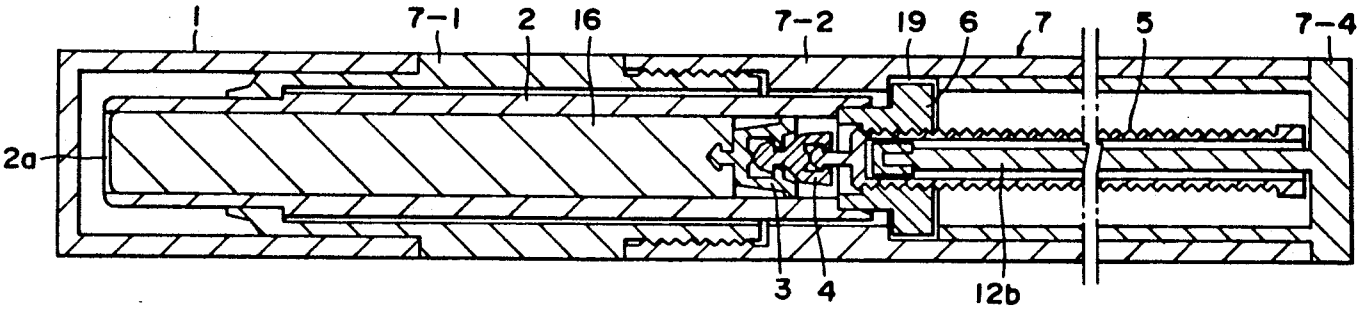
FIG. 13 is a longitudinal sectional view showing a fifth embodiment.

FIG. 13 shows the fifth embodiment. This embodiment does not use a rotatable knob like the rotatable knob in the embodiment of FIG. 11, but has a mere tail crown 7-4 fitted in the rear tubular shaft 7-2. The grooves 7*e* (FIG. 11) for preventing the rotation of the female screw member 6 in the embodiment FIG. 11 are not formed in the rear tubular shaft 7-2 of this embodiment. Instead, the movement of the female screw member 6 in the forward and backward direction is prevented by an annular recess 19 defined by the rear tubular shaft 7-2 and the tail crown 7-4. In other words, this embodiment represents an example where the male screw member 5 can advance due to the rotation of the female screw member 6.

In the embodiment of FIG. 13, this rotation is caused by rotating the portion of the container 2 projecting from the front shaft 7-1. Although it is preferred in the foregoing embodiments that the front shaft 7-1 and the container 2 are stationary as much as possible for the purpose of positioning, they can rotate relatively in this embodiment. The female screw member 6 is rotated with the container 2 and this can be accomplished by utilizing a pressing fit or by providing the insertion portion with an irregular cross section.

The crown 4 at the tip of the male screw member 5 is fitted to the piston 3. If the rotation of the female screw member 6 is reversed, the male screw member 5 moves back.

Figure 14:
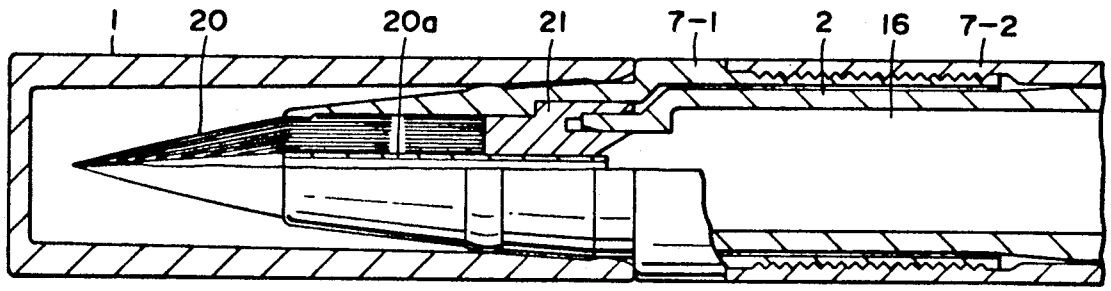
FIG. 14 is a longitudinal sectional view showing the front part of a sixth embodiment.

FIGS. 14 through 18 show the sixth embodiment. In FIG. 14 which shows a front part of a writing brush, a pipe 20*a* of a reduced diameter is fitted to the intermediate part of the brush and a fixing member 21 fixes the tip 20 and the pipe 20*a*. The container 2 which acts as a cartridge for dispensed fluid is fixed, too, by this fixing member 21. The content 16 stored in the container 2 is a fluid such as a liquid cosmetic, ink, and the like.

In other words, this embodiment is an example of a coating instrument for a liquid. The container 2 can have a plug at its tip similar to a cartridge of an ordinary fountain pen.

Figure 15:
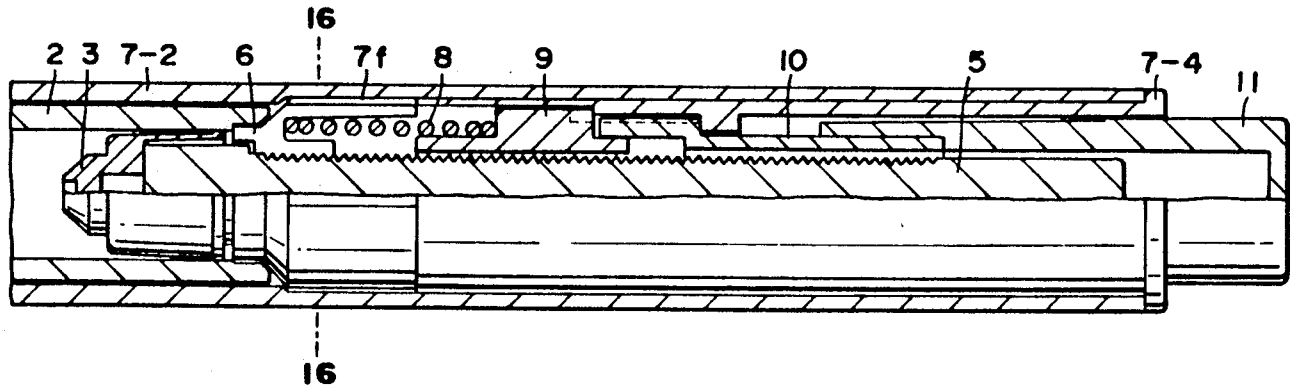
FIG. 15 is a longitudinal sectional view showing the rear part.

In FIG. 15 showing a rear portion of the writing brush, the piston 3 is shaped in such a manner as to minimize the remaining quantity of the content 16 stored in the container 2. The male screw member 5 is in contact with the rear part of the piston 3. In other words, this embodiment does not use a crown such as the crown 4 in the previous embodiments. The torsional force acting on the piston 3 can be minimized by selecting a suitable material. It is advisable to use, for example, polyethylene or polypropylene for both the container 2 and piston 3, and ABS resin for the male screw member and polyacetal for the female screw member 6. The combination of these materials is preferred for the purpose of making the relative rotation between the male screw member 5 and the female screw member 6 smooth.

Figure 16:
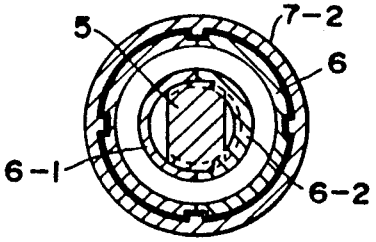
FIG. 16 is a transverse sectional view taken along line 16—16 of FIG. 15.
Figure 17:
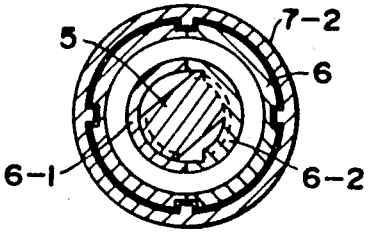
FIGS. 17 and 18 are, similar to FIG. 16, transverse sectional views showing the relation of relative rotation between a male screw member and a female screw member.
Figure 18:
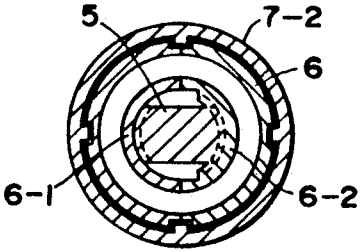

The female screw member 6 of this embodiment consists of two female screw plates 6-1 and 6-2 the same as in the first to third embodiments (see FIG. 16). However, the screw portion is not formed on both the female screw plates 6-1, 6-2 but is formed on only the female screw plate 6-2 on the right side in FIG. 16, which is shown by the accurately extending dotted line in the drawing. This is one of the means which can attain engagement and disengagement even with a small amount of opening of the parts, and no trouble occurs according to this embodiment as shown in FIGS. 17 and 18. Though this embodiment, too, employs the rotary mechanism which has already been described, the female screw member 6 is positioned at the recess **7*f* defined by the rear tubular shaft 7-2 and the tail crown 7-4 and is prevented from falling off even when it is separated from the container 2. Moreover, prevention of rotation is effected at four positions and not at two positions, and sliding of the slider 10 is between the female screw member 6 and the inner wall of the tail crown 7-4**.

Figure 19:
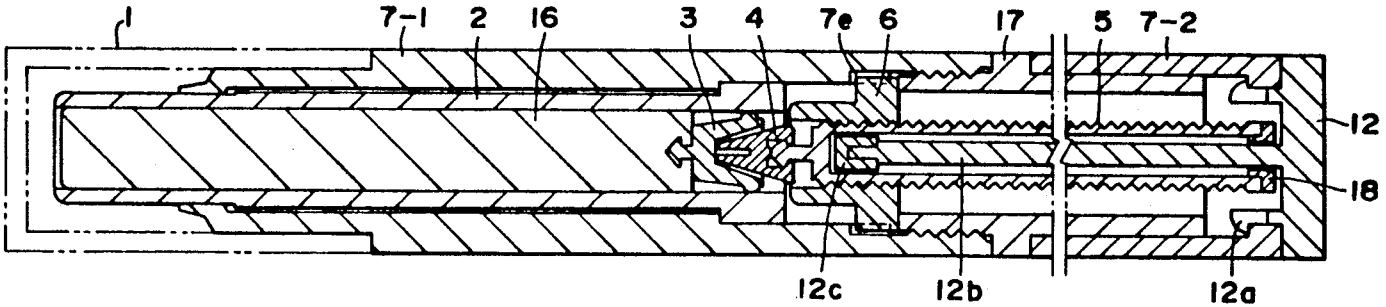
FIG. 19 is a longitudinal sectional view showing a seventh embodiment.

FIG. 19 shows the seventh embodiment. This embodiment is a simple modification of, and extremely analogous to, the fourth embodiment of FIGS. 11 and 12. The advance mechanism of the male screw member 5 is exactly the same. The differences reside in that the rear tubular shaft 7-2, the ring member 7-3 and the retreat prevention member 17 have a simplified structure, their entire length is reduced so as to permit the female screw member 6 to project from them, the front shaft 7-1 is elongated by a length corresponding to the reduction of length of these parts and the container 2 is anchored at its rear portion to the front shaft 7-1. The tip of the male screw member 5 projects from the entire rear tubular shaft 7-2 assembly, inclusive of the female screw member 6. This also holds true of the initial state of screw engagement as shown in FIG. 19. To replace the container 2, therefore, the front shaft 7-1 is separated from the rear tubular shaft 7-2 (the retreat prevention member may be regarded as part of the rear tubular shaft 7-2), the positional relation between a desired container 2 and the male screw member 5 is confirmed and the male screw member 5 and the knob 12 are then rotated relatively so that the male screw member 5 can be moved back and forth a desired distance while judging the distance with eyes.

Figure 20:
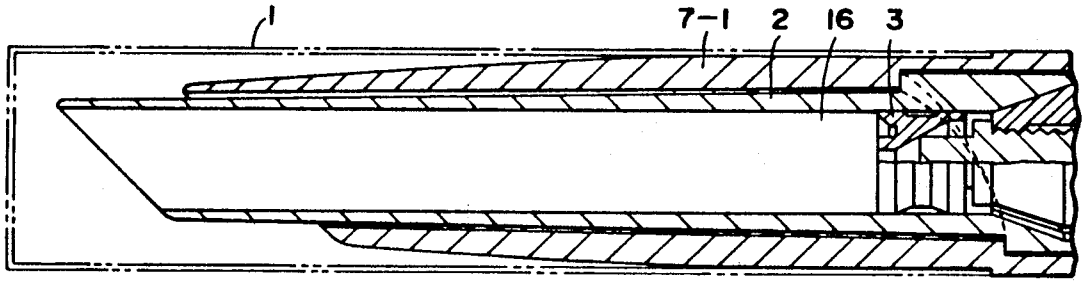
FIG. 20 is a longitudinal sectional view showing the front part of an eighth embodiment.
Figure 21:
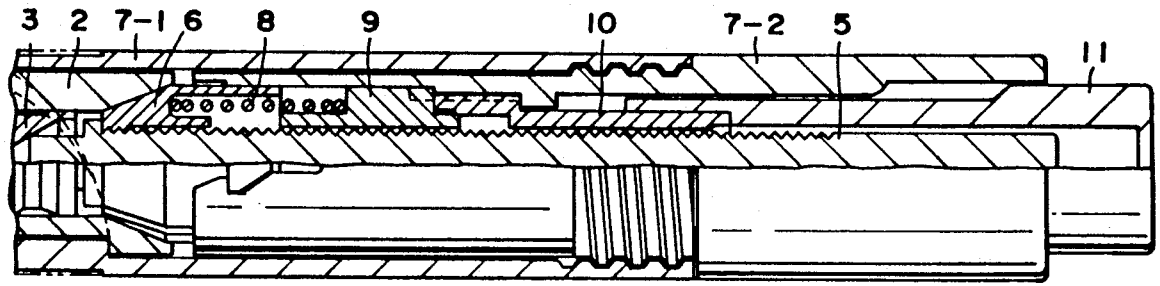
FIG. 21 is a longitudinal sectional view showing the rear part thereof.

Finally, FIGS. 20 to 41 show the eight embodiment. Though overlapping partially, FIG. 20 shows the front portion and FIG. 21 shows the rear portion. As can be seen from the drawings, this embodiment, too, is equipped with the rotary mechanism. This embodiment has all the aforementioned five features of the invention, and the mechanical portion is an integral assembly. The container 2 is assembled to this assembly. The front shaft 7-1 may be regarded as an inclusion. Though the shape is different as will be described later, the female screw member consists of a plurality of female screw plates. Therefore, the female screw member 6 is automatically provided with play for assembly. In addition, the female screw member 6 is directly fitted to the rear end portion of the container (cartridge) 2. The male screw member 5 meshing with this female screw member 6 projects from the tip of the rear tubular shaft 7-2 even at the initial state of meshing. In other words, this embodiment can be regarded as the most preferred embodiment in comparison with all the foregoing embodiments. Accordingly, each constituent member of this embodiment will be shown in the drawing and be explained once again with some modified embodiments thereof.

Figure 22:
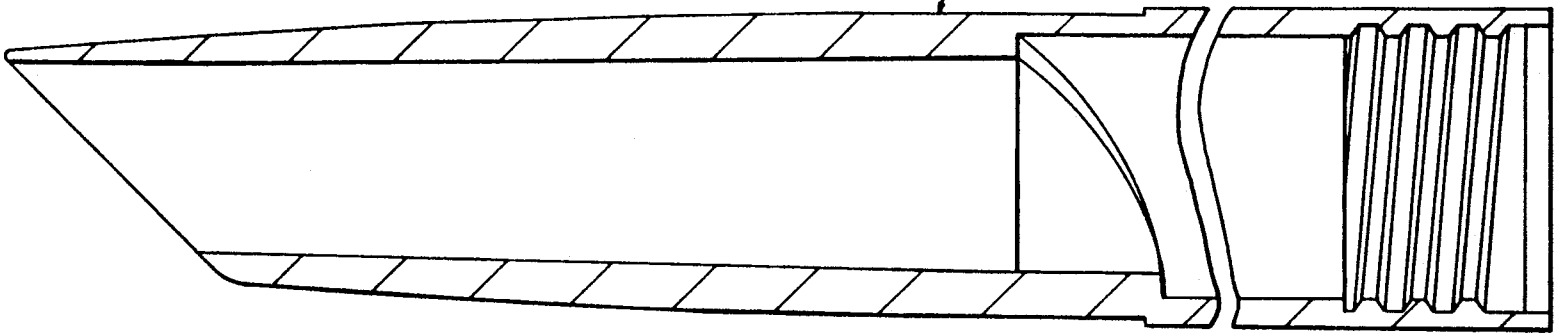

FIG. 22 shows the front tubular shaft 7-1. The tip opens slantingly. When the dispenser of this invention is used for a lip color or a paste, for example, it is sometimes preferred that the open direction is predetermined. The angle of inclination of the opening can be selected suitably.

Figure 23:
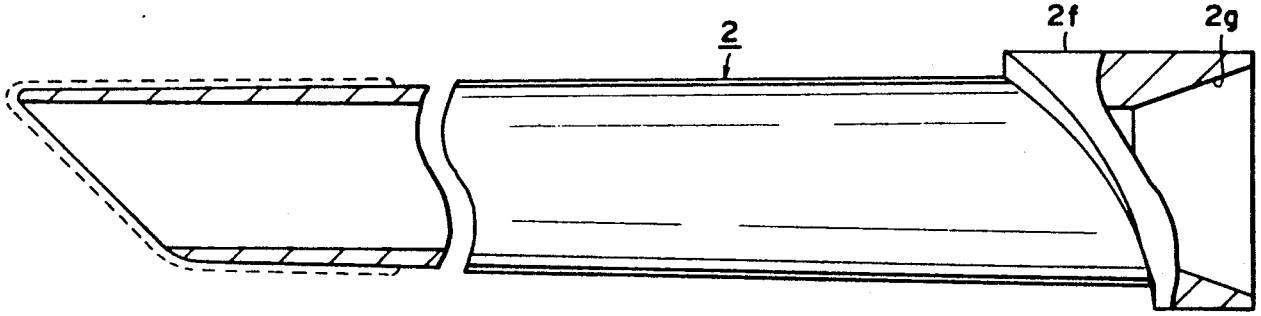

FIG. 23 shows the container 2. The front tubular shaft 7-1 opens slantingly in the same way. Its front end has a rear portion **2*f* having an inclined front portion and having a large diameter. A hole corresponding to the rear portion 2*f* is formed in the front tubular shaft 7-1. Therefore, the relation of their rotational positions can be determined at the time of assembly. The inner hole is a tapered hole 2*g* having a diameter which increases progressively rearwardly, at the rear end portion. In the drawing, a portion represented by dotted line at the front portion shows the container 2 can be formed in various forms by, for example, implanting hairs or bonding a soft sponge to this portion to obtain a soft touch at the time of use or to limit horizontal rocking movement with respect to the front shaft 7-1**.

Figure 24:
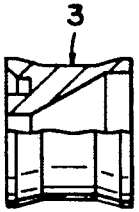

FIG. 24 shows the piston 3. The shape of the piston 3 is arbitrary. It is rather unnecessary if the content 16 (not shown) can be discharged directly by the male screw member 5. However, the content 16 is sometimes a fluid as described above or there is the case where it is better to discharge the content 16 indirectly by the male screw member 5 even if the content 16 does not have fluidity. The advance of the male screw member 5 becomes smooth if the arrangement is employed such that the contact force with the inner wall of the container 2 primarily exists at the back of the contact portion with the male screw member 5.

Figure 25:
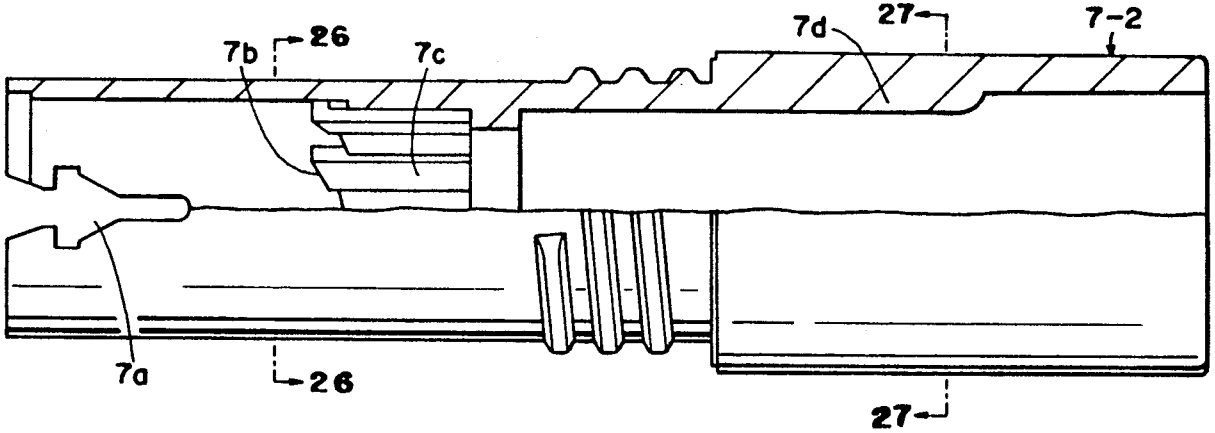
Figure 27:
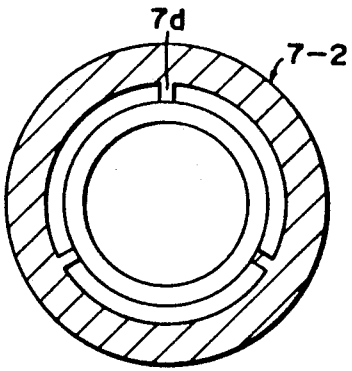
Figure 26:
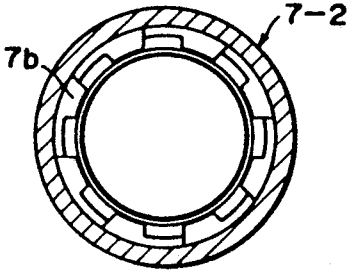

FIGS. 25 to 27 show the rear shaft 7-2. The notch **7*a* for fitting the female screw member 6, which will be described presently, and the projection 7*c* whose front end 7*b* for constituting part of the rotary mechanism is a unidirectional slope are shown in the drawings. This embodiment is provided with ribs 7*d* in order to make the forward and backward movement of the slider 10** smooth.

Figure 28:
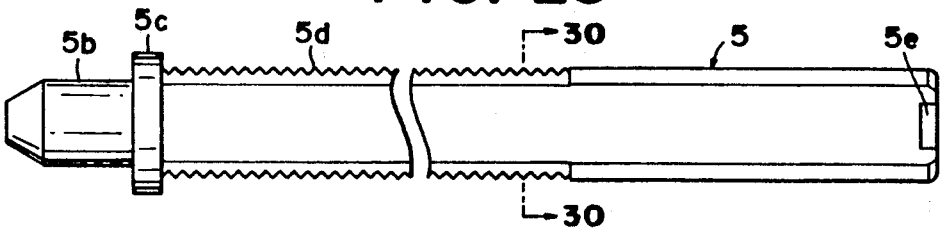
Figure 30:
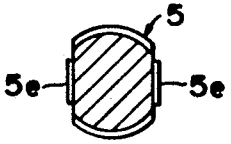
Figure 29:
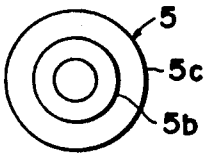

Next, FIGS. 28 to 30 show the male screw member 5. It includes tip **5*b* consisting of a truncated cone portion and column portion extending from the former, a flange 5*c* which is positioned at the rear end of the tip 5*b* and allows the tip 5*b* always to project from the rear tubular shaft 7-2, a male screw portion 5*b* which extends from the black of this flange 5*c* and a projection 5*e* which is provided in order to prevent the male screw member 5 from falling out of the female screw member 6. The male screw portion 5*d* and its rear portion have an irregular-shaped cross section. The tip 5*b* is depicted as a mere column portion in FIGS. 28 and 29 as a modified example. One of the means for reducing the torsional force acting on the piston 3 as much as possible is to minimize the contact area. In this embodiment, the tip 5*b* and the flange 5*c*** form the tip of the instrument.

Figure 32:
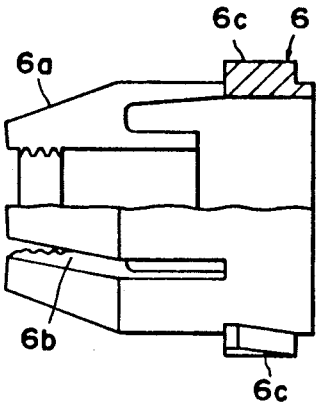
Figure 34:
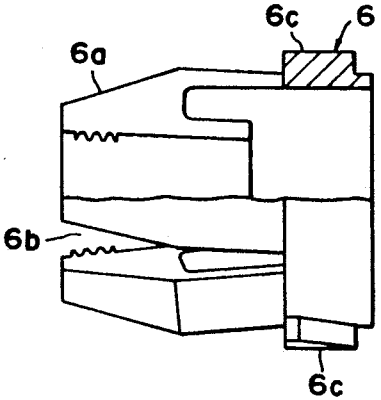
Figure 31:
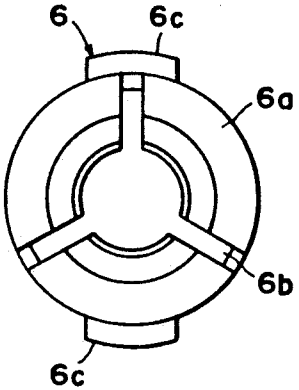
Figure 33:
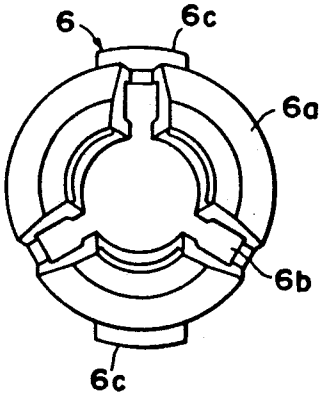
Figure 42:
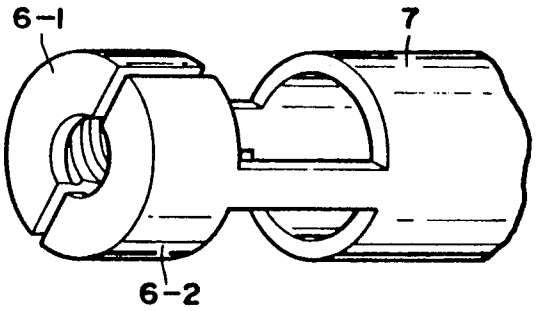
FIG. 42 is a perspective view showing a modified example of the female screw member and the shaft main body.

FIGS. 31 to 34 show the female screw portion 6. FIGS. 31 and 32 show the assembled state such as shown in FIGS. 20 and 21, and FIGS. 33 and 34 shows the molded state. In other words, the female screw member 6 of this embodiment exhibits resilience and when the tapered front end portion **6*a* is brought into contact with the tapered hole 2*g* of the container 2, the slits 6b disposed at 120° are narrowed. The portions divided by the slits 6b correspond to the female screw plates. In this embodiment, the number of and the quantity of the portions are arbitrary. In the drawing the portion which is to be fitted in the notch 7a of the rear tubular shaft 7-2 is represented by reference number 6c**.

Figure 36:
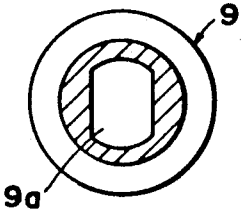
Figure 35:
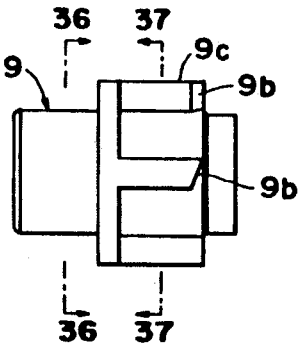
Figure 37:
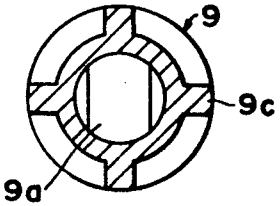

FIGS. 35 to 37 shows the rotor 9. It has an inner hole 9a part of the length of which has an irregular-shaped cross section.

Figure 39:
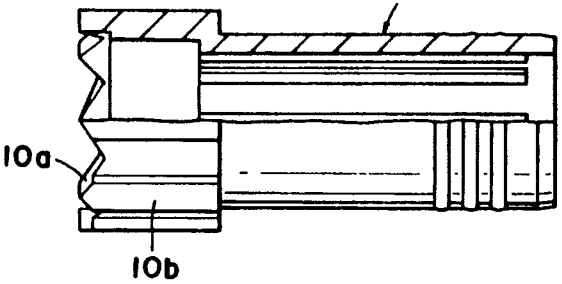
Figure 38:
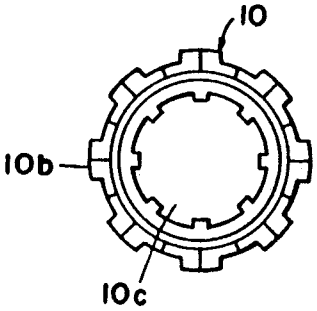

FIGS. 38 and 39 show slider 10. The front ends 10a of the projections 10b of the slider 10 in this embodiment are not of unidirectional slope, but functionally, they are unidirectional in the same way as in the foregoing embodiments with the exception that the rotation of the rotor 9 becomes step-wise. The slider 10 of this embodiment has a through-hole 10c which has a diameter so as not to hinder the rotation and movement of the male screw member 5.

Figure 40:
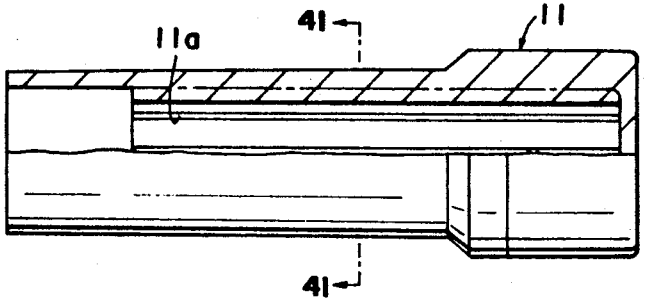
Figure 41:
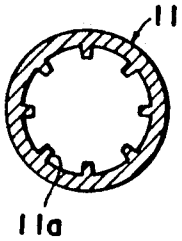

FIGS. 40 and 41 show the pusher 11. It has projections 11a that extend radially inwardly so that the slider 10 can be fitted easily and reliably. However, the components may be integrated suitably or a composite component, and the slider 10 and the pusher 11 may be formed in a unitary structure.

Various modifications can be made besides those described above. For example, the female screw plates 6-1, 6-2 and the tubular shaft 7 may be integrated, and the irregular-shaped cross sections of the male screw member 5 and the rotor 9 may be combined suitably. The dispenser may be equipped with a communicated porous member in place of the tip of the brush, for example. Furthermore, besides the dispenser which is gripped by the hand and pressed by the fingers, it is possible to constitute the dispenser of the type wherein the pusher 11 or the knob 12 is made operative in an interlocking arrangement with elements for longitudinal movement or for rotation of a machine having such elements.

The dispenser of the present invention provides an assembly which can be a better dispenser mechanically and can control and stabilize the quantity of the content extruded, though the structure becomes somewhat complicated.

What is claimed is:

1. A dispenser, comprising:

an elongated container having a storage portion for storing material to be dispensed;

a female screw member fitted in the interior of said elongated container and held against longitudinal movement therealong;

a male screw member having a press portion at one end thereof engaged with material in said storage portion and rotatably engageable with said female screw member for, when said male screw member is moved axially within said elongated container, a material stored in said storage portion is pressed by said press portion and discharged out of said dispenser;

means connected to said screw members for rotating said screw members relative to each other for axially moving said male screw member within said container relative to said female screw member;

said female screw member having a plurality of parts, at least one of which is threaded, movable inwardly and outwardly of said male screw member for changing the diameter of said female screw member for engaging the female screw member with said male screw member and releasing the engagement of said female screw member and said male screw member; and means engaged by said female screw member for moving said parts inwardly into engagement with said male screw member and holding said parts in such engagement.

2. A dispenser as claimed in claim 1 in which said female screw member has at least two separate threaded parts and said means for moving said threaded parts comprises means for moving said parts radially inwardly into engagement with said male screw member.

3. A dispenser as claimed in claim 2 in which said male screw member is rotatable and said male screw member and said means for rotating said screw members relative to each other comprises means connected to said male screw member for rotating said male screw member, and said male screw member and said means for rotating said male screw member and said female screw member are assembled in a unit insertable into said container, and said means for moving said threaded parts comprises an inwardly tapered portion on said container engageable with said female screw member for urging said threaded parts radially inwardly.

4. A dispenser as claimed in claim 1 in which said female screw member has only one of said parts threaded and threadedly engageable with said male screw member when moved inwardly, the remaining parts engaging said male screw member in non-threaded engagement when moved inwardly.

5. A dispenser as claimed in claim 1 in which said female screw member has a plurality of threaded parts extending parallel to the axis of said male threaded member and being circumferentially joined to each other at the ends remote from said container and having the other ends movable away from each other outwardly of the male screw member, said means for rotating said screw members comprises means for rotating said male screw member, said male screw member and said means for rotating said male screw member and said female screw member being assembled into a unit and insertable into said container, and said means for moving said threaded parts comprises a tapered recess on the end of said container toward said screw members into which said other ends of said threaded parts are engaged for pivoting said parts inwardly into engagement with said male screw member when said assembled male screw member, said means for rotating said male screw member and said female screw member are inserted into said container.

6. A dispenser, comprising:

an elongated container having a storage portion for storing material to be dispensed;

a female screw member fitted in the interior of said elongated container and held against longitudinal movement therealong;

a male screw member having a press portion at one end thereof engaged with material in said storage portion and rotatably engageable with said female screw member for, when said male screw member is moved axially within said elongated container, a material stored in said storage portion is pressed by said press portion and discharged out of said dispenser;

means connected to said screw members for rotating said screw members relative to each other for axially moving said male screw member within said container relative to said female screw member;

said female screw member being movable inwardly and outwardly of said male screw member for changing the diameter of said female screw member for engaging the female screw member with said male screw member and releasing the engagement of said female screw member and said male screw member; and said female screw member being manually engageable from outside said container for moving said female screw member inwardly into engagement with said male screw member and holding said parts in such engagement.

* * * * *